US009623305B2

(12) United States Patent
Bohannon

(10) Patent No.: US 9,623,305 B2
(45) Date of Patent: Apr. 18, 2017

(54) GOLF CLUB HEAD COVER

(71) Applicant: Jeremiah Bohannon, Bend, OR (US)

(72) Inventor: Jeremiah Bohannon, Bend, OR (US)

(73) Assignee: Frogger, LLC, Bend, OR (US)

( * ) Notice: Subject to any disclaimer, the term of this patent is extended or adjusted under 35 U.S.C. 154(b) by 56 days.

(21) Appl. No.: 14/673,396

(22) Filed: Mar. 30, 2015

(65) Prior Publication Data

US 2016/0287957 A1 Oct. 6, 2016

(51) Int. Cl.
*A63B 55/02* (2006.01)
*A63B 60/62* (2015.01)
*A63B 102/32* (2015.01)

(52) U.S. Cl.
CPC ..... *A63B 60/62* (2015.10); *A63B 2102/32* (2015.10); *A63B 2209/08* (2013.01)

(58) Field of Classification Search
CPC .... A63B 55/007; A63B 2209/08; A63B 60/62
USPC ..... 150/160; 206/315.2
See application file for complete search history.

(56) References Cited

U.S. PATENT DOCUMENTS 3,117,609 A * 1/1964 Pio ..... A63B 60/62 150/160
3,548,908 A * 12/1970 Koetting ..... A63B 60/62 150/160
3,593,769 A * 7/1971 Spears ..... A63B 60/62 150/160
3,664,399 A * 5/1972 Neff ..... A63B 60/62 150/160
4,195,677 A * 4/1980 Hagg ..... A63B 60/62 150/160
5,000,238 A * 3/1991 Zeller ..... A63B 60/62 150/160
5,050,655 A * 9/1991 Borenstein ..... A63B 60/62 15/105
5,860,519 A * 1/1999 Meyer ..... A63B 55/00 206/315.1
6,119,742 A 9/2000 Maeng
6,202,723 B1 3/2001 Maeng
6,793,072 B2 9/2004 Maeng
6,874,627 B2 4/2005 Maeng
7,597,126 B2 10/2009 Chen
7,686,049 B2 3/2010 Hwang
7,699,083 B1 4/2010 Kim
7,832,438 B2 11/2010 Cameron
(Continued)

*Primary Examiner* — Sue A Weaver
(74) *Attorney, Agent, or Firm* — Matthew J. Lattig; Charter IP, LLC

(57) ABSTRACT

A golf club head cover for releasable connection to a shaft and head of a golf club includes a cover body for detachably covering the club head, the cover body having a head portion with a top surface that has a flexible longitudinal portion formed therein adapted to separate the head portion into two half-head portions adapted to articulate about the flexible portion. A front facing surface of the head portion includes a slit separating it into two wings. A shank portion of the cover body extends downwardly to enclose a portion of the shaft of the golf club. The cover body further includes a fastening means composed of a first part secured within each half-head portion for selectively affixing the cover body in an open position, and a second part secured within each wing for selectively affixing the cover body in a closed position about the golf club head.

17 Claims, 2 Drawing Sheets

(56) References Cited

U.S. PATENT DOCUMENTS

| | | | | |
|---|---|---|---|---|
| 7,954,526 | B2 | 6/2011 | Chen | |
| 8,201,602 | B2 | 6/2012 | Maeng et al. | |
| 8,225,830 | B2 | 7/2012 | Maeng et al. | |
| 8,276,627 | B2 | 10/2012 | Gaffney | |
| 8,371,347 | B2 | 2/2013 | Cameron | |
| 8,387,669 | B2 | 3/2013 | Chen | |
| 8,844,588 | B2 | 9/2014 | Low et al. | |
| 9,381,411 | B2 * | 7/2016 | Higdon | A63B 60/62 |
| 2003/0075252 | A1 * | 4/2003 | Noyes | A63B 60/62 150/160 |
| 2005/0016648 | A1 | 1/2005 | Vakharia et al. | |
| 2007/0068611 | A1 | 3/2007 | Hwang | |
| 2007/0261772 | A1 * | 11/2007 | Chow | A63B 60/62 150/160 |
| 2008/0047639 | A1 * | 2/2008 | Fox | A24F 13/22 150/160 |
| 2008/0230159 | A1 | 9/2008 | Tan | |
| 2011/0265922 | A1 | 11/2011 | Gaffney | |
| 2012/0125497 | A1 | 5/2012 | Gaffney | |
| 2013/0213538 | A1 | 8/2013 | Gaffney | |
| 2014/0202603 | A1 | 7/2014 | Huang | |

* cited by examiner

GOLF CLUB HEAD COVER

BACKGROUND

Field

The example embodiments in general are directed to a golf club head cover, more particularly to a body of the cover having a portion thereof partitioned into adjacent head portions and wings adapted to be releasable connected to one another around a golf club head and shaft via one or more magnets.

Related Art

Golfers typically carry a set of different types of clubs (drivers/woods and hybrids, irons, wedges, and a putter) in a golf bag into which the club shafts and handles are inserted after inverting the club to cause the heads to extend out of the open end of the bag. As the bag is carried or driven from place to place, the heads of the golf clubs may be repeatedly struck and battered. This also can occur when clubs are removed and inserted into the golf bag.

"Sock"—type golf club head covers have been constructed particularly for protecting the drivers and fairway woods. The sock portions of these head covers generally have an elastic or knit neck or shank portion on them to hold them in place over the driver/wood/hybrid when it is in the bag. However, this shank portion often gets caught on other equipment (such as on water retrieval tools for balls) which causes it to become snagged, ripped or torn. Additionally, the golfer often has to take the time to fully secure the cover over the club head and pull the sock-type shank portion down completely along and over the shaft of the club; otherwise the head cover may inch up and become separated from the club head, and hence lost, due to the vibrations imparted thereto by carrying the clubs or driving a golf cart with the bag secured thereon. Further, the tolerances or tightness between the shank portion and shaft, and the amount of stretch required to remove the shank portion of the head cover over the now-large or oversized heads of today's drivers can be cumbersome to the golfer.

Consequently, there is a significant need in the golf industry for a protective head cover for golf clubs that provides the desired protection, stays in place, and which is easier and quicker to put on and remove as compared to conventional, sock-type covers.

SUMMARY

An example embodiment is directed to a protective cover body for detachably covering a head of a golf club. The cover body includes a head portion for covering and protecting the club head, the head portion having a top surface that is bisected centrally from the front of the body to the rear into at least two pivotable half-head portions adapted to articulate about a central pivot axis therebetween, the head portion including a front facing surface at a front of the cover body having a slit formed therein separating the front facing surface into two separable wings, and a shank portion for enclosing a portion of a shaft of the club. The cover body further includes an elastic seam member extending rearward centrally on the top surface from the front facing surface toward the rear of the cover body so as to bisect the top surface of the head portion into its at least two half-head portions, the elastic seam member serving as a central pivot point between the pivotable half-head portions, and a fastening means. The fastening means further includes a first part secured within each half-head portion for selectively affixing the cover body in an open position with the at least two half head portions pivoted along the elastic seam and in contact with one other and the wings spread apart from one another to allow access to or to place a golf club head therein, and a second part secured within each wing for selectively affixing the cover body in a closed position about the golf club head with the half-head portions separated and wings attached to one another.

Another example embodiment is directed to a head cover for a golf club having a cover body with a front that is adapted to receive the golf club therein and a rear. The cover body includes a head portion having a top surface with a central elastic seam member that extends rearward from the front of the cover body to the rear thereof. The central elastic seam member bisects the head portion into at least two pivotable half-head portions that each are adapted to pivot about the central seam member. Each half-head portion includes a magnetized material that attract one another as a user brings the two half-head portions together for affixing the cover body in an open position. The cover body further includes a shank portion extending downwardly from the head portion to enclose a portion of a shaft of the golf club.

Another example embodiment is directed to a head cover for a golf club having a cover body with a front that is adapted to receive a head of the golf club therein and a rear. The cover body includes a head portion for covering and protecting the club head, the head portion having one or more magnetized materials for opening the front of the cover body or affixing the cover body in a closed position, and an elastic seam member located centrally on a top surface of the head portion and extending from the front to the rear of the cover body so as to bisect the top surface into two pivotable half-head portions. The elastic seam member serves as a central pivot point between the pivotable half-head portions, with the half-head portions being adapted to pivot up and toward one another so that the magnetized materials hold the half-head portions together, opening the front of the cover body to access or place the club head. The cover body further includes a shank portion adapted to enclose a portion of the shaft of the golf club.

BRIEF DESCRIPTION OF THE DRAWINGS

Example embodiments will become more fully understood from the detailed description given herein below and the accompanying drawings, wherein like elements are represented by like reference numerals, which are given by way of illustration only and thus are not limitative of the example embodiments herein.

DETAILED DESCRIPTION

Figure 1:
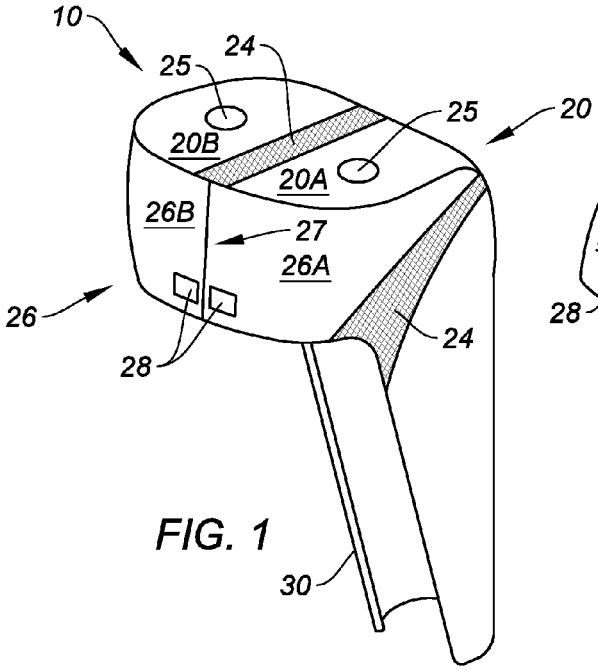
FIG. 1 shows a perspective view of a protective body of a head cover for detachably covering a head of a golf club in a closed position, according to an example embodiment.

In the following description, certain specific details are set forth in order to provide a thorough understanding of various example embodiments of the disclosure. However, one skilled in the art will understand that the disclosure may be practiced without these specific details. In other instances, well-known structures associated with manufacturing techniques have not been described in detail to avoid unnecessarily obscuring the descriptions of the example embodiments of the present disclosure.

Unless the context requires otherwise, throughout the specification and claims that follow, the word "comprise" and variations thereof, such as "comprises" and "comprising," are to be construed in an open, inclusive sense, that is, as "including, but not limited to."

Reference throughout this specification to "one example embodiment" or "an embodiment" means that a particular feature, structure or characteristic described in connection with the embodiment is included in at least one embodiment. Thus, the appearances of the phrases "in one example embodiment" or "in an embodiment" in various places throughout this specification are not necessarily all referring to the same embodiment. Further, the particular features, structures or characteristics may be combined in any suitable manner in one or more example embodiments.

As used in this specification and the appended claims, the singular forms "a," "an," and "the" include plural referents unless the content clearly dictates otherwise. The term "or" is generally employed in its sense including "and/or" unless the content clearly dictates otherwise.

As used in the specification and appended claims, the terms "correspond," "corresponds," and "corresponding" are intended to describe a ratio of or a similarity between referenced objects. The use of "correspond" or one of its forms should not be construed to mean the exact shape or size.

In the drawings, identical reference numbers identify similar elements or acts. The size and relative positions of elements in the drawings are not necessarily drawn to scale.

Figure 2:
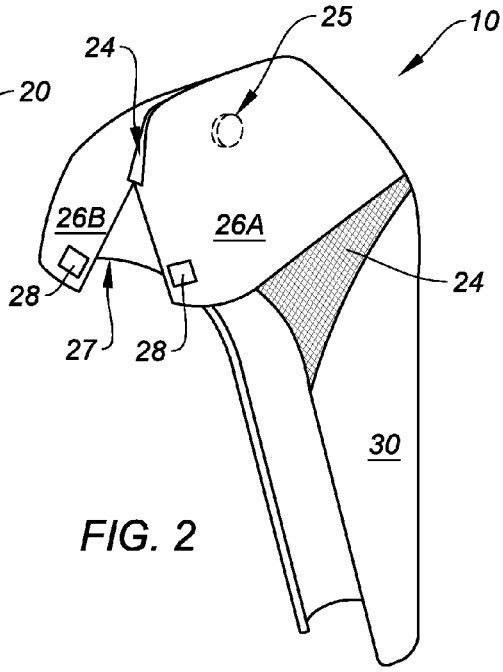
FIG. 2 shows a perspective view of the head cover in an open position to access or place the club head therein.
Figure 3:
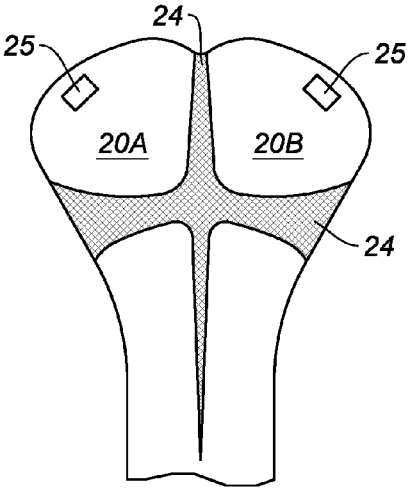
FIG. 3 shows a rear plan view of an upper portion of the cover body in the closed position according to FIG. 1.

The example embodiments hereafter describe a golf club head cover, more particularly the structure of a protective body of the cover for detachably covering a head of a golf club. Referring to FIGS. 1-5, there is shown a protective cover body ("hereafter "body 10") of a head cover. The body 10 includes an upper head portion 20 adapted to cover and protect the head of a golf club (not shown), and a lower shank portion 30 designed to fit over and protect a portion of a shaft of the club attached to the club head. The head portion 20 includes a top surface with an elastic or flexible seam or longitudinal portion or 24 formed therein. As can be readily seen from the drawings, longitudinal portion 24 is adapted to separate the head portion 20 into at least two half-head portions 20A, 20B adapted to articulate or pivot about longitudinal portion 24. In an example, longitudinal portion 24 may bisect the head portion 20 and extend to the rear surface of body 10, as best shown in FIG. 2. Although this example describes a seam or longitudinal portion 24 which bisects head portion 20 into at least two half-head portions 20A, 20B, greater than two (three, four, etc.) portions may be created by the flexible seam.

Head portion 20 further includes a front facing surface 26 having a slit 27 formed therein. Slit 27 thus separates the front facing surface 26 into two wings, identified by elements 26A and 26B. Body 10 further includes the lower shank portion 30 extending downwardly from the head portion 20 for enclosing a portion of a shaft of the golf club attached to the club head.

To secure the body 10 of the head cover to the club head and shaft of a golf club, a fastening means is provided. In an example, the fastening means may comprise a first part secured within each half-head portion 20A, 20B (such as sewn, embedded or otherwise provided slightly beneath the material that forms the head portion 20 of body 10) for selectively affixing the body 10 in an open position, and a second part secured within each wing 26A, 26B (such as sewn, embedded or otherwise provided slightly beneath the material that forms the front surface portion 26 of body 10) for selectively affixing the body 10 in a closed position about the golf club head.

In an example, the first part may be embodied as at least one first magnet 25 embedded in each half-head portion 20A, 20B. Magnets 25 may be adapted to come into proximal facing relation to each other with maximum magnetic attraction as the golfer (user) brings the two half-head portions 20A, 20B together at flexible seam 24 for affixing the cover body 10 in an open position, as best shown in the perspective of FIG. 2.

Figure 4:
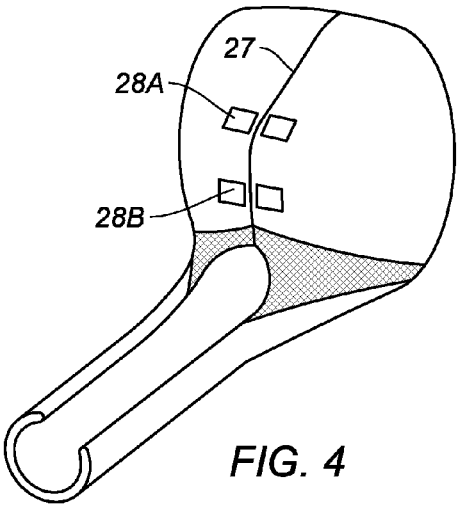
FIG. 4 shows a front plan view of the cover body in the closed position according to FIG. 1.
Figure 5:
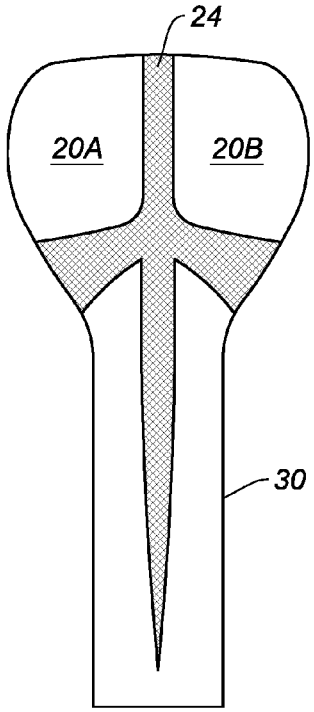
FIG. 5 shows a rear plan view of the complete cover body with shank portion in thee closed position according to FIG. 1.

In an example, the second part of the fastening means may be embodied as at least one second magnet 28 embedded in each wing 26A, 26B. The second magnets 28 may also be adapted to come into proximal facing relation to each other with maximum magnetic attraction as the golfer brings the two wings 26A, 26B together for affixing the body 10 in a closed position. In another example, the second part of the fastening means may comprise two pairs of second magnets 28, each pair embedded in a corresponding wing 26A, 26B, as best shown in FIG. 4. Any one of the at least one first and second magnets 25, 28 may be adjustable to vary the pull force of magnetic attraction.

A magnet is any object that has a magnetic field. It attracts ferrous objects like pieces of iron, steel, nickel and cobalt. In the early days, the Greeks observed that the naturally occurring "'lodestone" attracted iron pieces. Today, magnets are made artificially in various shapes and sizes depending on their use.

Pull force is the force required to pull a magnet free from a flat steel plate using a force that is perpendicular to the surface. It is the limit of the holding power of a magnet.

Gaussmeters are used to measure the magnetic field density at the surface of the magnet. This is referred to as the surface field and is measured in Gauss (or Tesla). Pull force testers are used to test the holding force (pull force) of a magnet that is in contact with a flat steel plate. Pull forces are measured in pounds (or kilograms).

Typically magnets may be tested in a few different configurations. One test measures the maximum pull force in pounds (or kilograms) generated between a single magnet and a thick, ground, flat steel plate. Another test measures the maximum pull force generated with a single magnet sandwiched between two thick, ground, flat steel plates. A third test, relevant to the example embodiments herein, measures maximum pull force generated on a magnet attracted to another magnet of the same type.

The calculated pull force values are normally determined from an average value for five samples of each magnet. A digital force gauge records the tensile force on the magnet. The plates are pulled apart until the magnet disconnects from one of the plates. The peak value is recorded as the "pull force".

Neodymium iron boron (NdFeB, also known as Neo, NIB or super magnets) is the strongest commercial magnet material currently produced. Neodymium magnets are fabricated in many different shapes and sizes including discs, rings, and blocks, or custom, made-to-order neodymium magnets. Neodymium magnets typically have poor resistance to corrosion and they can also corrode from the inside out if proper pre-treatment processes are not followed. Thus, oftentimes multi-layer nickel-copper-nickel plating is applied. Magnets 25 and 28 may be embodied by NdFeB disc magnets which may include, but not be limited to, neodymium magnets Grade N42, 0.25" diameter×0.125" thick with a pull force between 0.25 to 4.9 pounds, commercially fabricated by APPLIED MAGNETS™ of Plano, Tex.

Samarium cobalt (SmCo) magnets, also known as rare earth magnets, typically are regarded as offering the best value when comparing performance and size in high temperature or adverse environments. SmCo magnets are higher in cost, but magnetically very strong and typically allow for dimensional reductions. SmCo rare earth magnets are substantially resistant to corrosion and do not normally require any surface treatment. These magnets can operate at temperatures up to 500° F. (260° C.), making these rare earth magnets ideal for high heat applications. Magnets 25 and 28 may be embodied by rare earth disc magnets including but not be limited to 0.25" diameter×0.125" thick samarium cobalt $Sm_2Co_{17}$ disc magnets with a pull force of at least 1.6 pounds, commercially fabricated by APPLIED MAGNETS.

Alnico magnets are largely comprised of aluminum (Al), nickel (Ni), and cobalt (Co), aluminum and other trace amounts of elements such as copper (Cu) and titanium (Ti) to tailor the alloy's magnetic and mechanical properties. Introduced in the 1930's, alnico magnets exhibit excellent temperature stability, high residual induction, relatively high energies and strong resistance to corrosion. These magnets are widely used for motor, sensor, separator, loudspeaker, electronic ignition systems, generators, vending machines, hand tools, magnetic reed switches, volt-amp meters, medical instruments and other magnetic applications. Magnets 25 and 28 may also be embodied by alnico magnets exhibiting a pull force of between about 0.25 to 4.9 pounds.

Accordingly, in one example construction, body 10 may be configured with first and second magnets 25, 28 exhibiting a pull force of less than five (5) pounds. In another example construction, body 10 may be configured with first and second magnets 25 and 28 exhibiting a pull force of in a range of between about 1.6 to 4.9 pounds. In yet a further example construction, body 10 may be configured with first and second magnets 25 and 28 exhibiting a pull force of in a range of between about 2.0 to 3.0 pounds. Moreover, the magnet size of the at least one first and second magnets 25, 28 may be adjustable to vary the pull force of magnetic attraction, based on the desired pull force.

In a further example, any of the head portion 20, front surface portion 26, and shank portion 30 of body 10 may be composed of a material selected from a group comprising leather, genuine rawhide and exotics, vinyl, neoprene, nylon, acrylic knits, plastics, cotton, sheepskin, polyesters, and combinations thereof.

Figure 6:
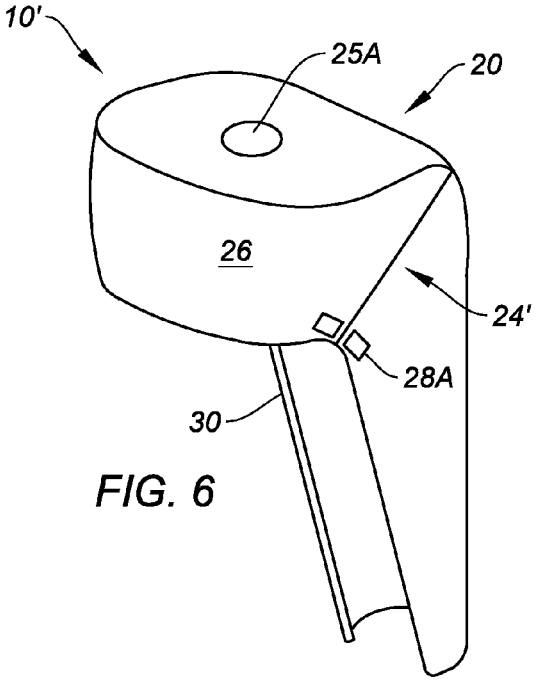
FIG. 6 shows a perspective view of a protective body of a head cover for detachably covering a head of a golf club, according to another example embodiment.
Figure 7:
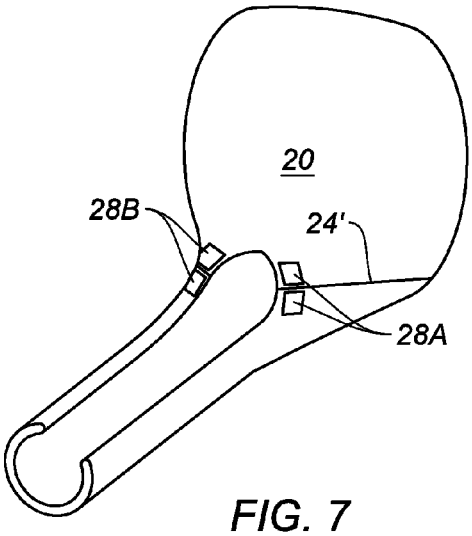
FIG. 7 shows a rear plan view of an upper portion of the cover body according to FIG. 6.
Figure 8:
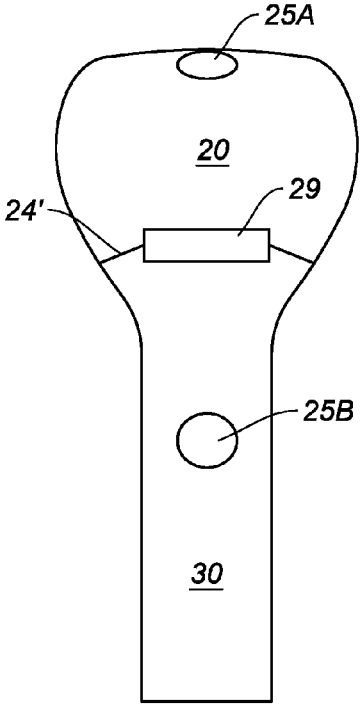
FIG. 8 shows a front plan view of the cover body according to FIG. 6.

FIGS. 6-8 are directed to another example embodiment. As many of the elements in these figures are the same as that shown in FIG. 1-5; only the differences are noted in detail for purposes of brevity. Referring to FIGS. 6-8, cover body 10' also includes an upper head portion 20 adapted to cover and protect the head of a golf club (not shown), and a lower shank portion 30 designed to fit over and protect a portion of the upper shaft. However, and unlike the first embodiment, the flexible, elastic seam or longitudinal portion 24' is formed along a lower rear surface of head portion 20, extending generally along each side of the body 10', and includes a stiffener element 29 along the seam 24' to facilitate pivotal movement of the entire head portion 20 relative to the shank portion 30. With this horizontal pivot point, the head portion 20 and the at least one magnet 25A on a surface of the head portion 20 may be oriented or pulled backward (pivoting at stiffener element 29 on seam 24') to contact a magnet 25B on the rear of shank portion 30. Although this example describes a seam or longitudinal portion 24' which facilitates pivotal movement of the entire head portion 20, it would be obvious to the skilled artisan that the head portion 20 could be divided into at least two half-head portions 20A, 20B (as shown in the previous example embodiment), and/or in to greater than two (three, four, etc.) portions formed by the flexible seam or longitudinal portion 24'.

Head portion 20 further includes a front facing surface 26 with at least one or more magnets thereon, identified in this example by elements 28A and 28B. Body 10' further includes a lower shank portion 30 extending downwardly from the head portion 20 for enclosing a portion of a shaft of the golf club attached to the club head. As shown best in FIGS. 6 and 7, an upper end of a front of the shank portion 30 may include magnets 28A/28B thereon. Similar to the first embodiment, the magnet size of any of magnets 25A/25B and/or 28A/28B may be adjustable to vary the pull force of magnetic attraction, based on the desired pull force.

To secure the body 10' of the head cover to the club head and shaft of a golf club, a fastening means is provided. In this example, the first and second parts constituting the fastening means may be magnets 25A/B and 28A/B, each of which may be sewn, embedded or otherwise provided slightly beneath the material that forms the head portion 20 and front facing surface 26 respectively of body 10' for selectively affixing the body 10' in an open or closed position about the golf club head.

The example embodiments having been described, it is apparent that such have many varied applications. For example, the example embodiments may be applicable but not limited to connection to various devices, structures and articles.

The present invention, in its various embodiments, configurations, and aspects, includes components, systems and/or apparatuses substantially as depicted and described herein, including various embodiments, sub-combinations, and subsets thereof. Those of skill in the art will understand how to make and use the present invention after understanding the present disclosure. The present invention, in its various embodiments, configurations, and aspects, includes providing devices in the absence of items not depicted and/or described herein or in various embodiments, configurations, or aspects hereof, including in the absence of such items as may have been used in previous devices, e.g., for improving performance, achieving ease and/or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights which include alternative embodiments, configurations, or aspects to the extent permitted, including alternate, interchangeable and/or equivalent structures to those claimed, whether or not such alternate, interchangeable and/or equivalent structures disclosed herein, and without intending to publicly dedicate any patentable subject matter.

I claim:

1. A protective cover body for detachably covering a head of a golf club, comprising:

a head portion for covering and protecting the club head, the head portion having a top surface that is bisected centrally from the front of the body to the rear into at least two pivotable half-head portions adapted to articulate about a central pivot axis therebetween, the head portion including a front facing surface at a front of the cover body having a slit formed therein separating the front facing surface into two separable wings, a shank portion for enclosing a portion of a shaft of the club, an elastic seam member extending rearward centrally on the top surface from the front facing surface toward the rear of the cover body so as to bisect the top surface of the head portion into its at least two half-head portions, the elastic seam member serving as a central pivot point between the pivotable half-head portions, and a fastening means including a first part secured within each half-head portion for selectively affixing the cover body in an open position with the at least two half head portions pivoted along the elastic seam and in contact with one other and the wings spread apart from one another to allow access to or to place the golf club head therein, and a second part secured within each wing for selectively affixing the cover body in a closed position about the golf club head with the half-head portions separated and wings attached to one another.

2. The body of claim 1, wherein the first part of the fastening means includes at least one first magnet attached to the first half-head portion, and one of a second magnet or a first ferrous material attached to the second half-head portion, the first magnet and second magnet or first ferrous material adapted to come into proximal facing relation to each other with maximum magnetic attraction as a user brings the two half-head portions together for affixing the cover body in an open position, and the second part of the fastening means includes one or more third magnets attached to one of the wings, and at least one of either one or more fourth magnets or a second ferrous material attached to the other wing, the one or more third magnets and at least one fourth magnet or second ferrous material adapted to come into proximal facing relation to each other with maximum magnetic attraction as a user brings the two wings together for affixing the cover body in a closed position.

3. The body of claim 2, wherein at least one of the first through fourth magnets exhibit a pull force of less than five (5) pounds.

4. The body of claim 2, wherein at least one of the first through fourth magnets exhibit a pull force in a range of between about 0.25 to 4.9 pounds.

5. The body of claim 2, wherein magnet size of any one of the at least one first through fourth magnets is adjustable to vary the pull force of magnetic attraction.

6. The body of claim 1, wherein the head portion is composed of a material selected from a group comprising leather, genuine rawhide and exotics, vinyl, neoprene, nylon, acrylic knits, plastics, cotton, sheepskin, polyesters, and combinations thereof.

7. The body of claim 1, wherein the shank portion is composed of a material selected from a group comprising leather, genuine rawhide and exotics, vinyl, neoprene, nylon, acrylic knits, plastics, cotton, sheepskin, polyesters, and combinations thereof.

8. The body of claim 1, wherein the second part of the fastening means includes two pairs of facing third and fourth magnets, each pair embedded in a corresponding wing.

9. A head cover for a golf club, comprising:

a cover body having a front that is adapted to receive the golf club head therein and a rear, the cover body including:

a head portion having a top surface with a central elastic seam member that extends rearward from the front of the cover body to the rear thereof, the central elastic seam member bisecting the head portion into at least two pivotable half-head portions adapted to pivot about the central seam member, each half-head portion including a magnetized material therein that attract one another as a user brings the two half-head portions together for affixing the cover body in an open position, and a shank portion extending downwardly from the head portion to enclose a portion of a shaft of the golf club.

10. The head cover of claim 9, wherein the magnetized materials exhibit a pull force of less than five (5) pounds.

11. The head cover of claim 9, wherein size of the magnetized materials is adjustable to vary the pull force of magnetic attraction.

12. The head cover of claim 9, wherein the head portion further includes a front facing surface having a slit therein separating the front facing surface into two wings, each wing including a magnetized material therein adapted so that the magnetized materials of the two wings come into proximal facing relation with maximum magnetic attraction as a user brings the two wings together for affixing the cover body in a closed position.

13. A head cover for a golf club, comprising:

a cover body having a front that is adapted to receive a head of the golf club therein and a rear, the cover body including:

a head portion for covering and protecting the club head, the head portion including one or more magnetized materials for opening the front of the cover body or affixing the cover body in a closed position, an elastic seam member located centrally on a top surface of the head portion and extending from the front to the rear of the cover body so as to bisect the top surface into two pivotable half-head portions, the elastic seam member serving as a central pivot point between the pivotable half-head portions, the half-head portions adapted to pivot up and toward one another so that the magnetized materials hold the half-head portions together, opening the front of the cover body to access or place the club head, and a shank portion adapted to enclose a portion of the shaft of the golf club.

14. The head cover of claim 13, wherein the head portion includes a front facing surface at the front of the cover body with a slit therein separating the front facing surface into two wings, each wing including a magnetized material therein adapted so that the magnetized materials of the two wings come into proximal facing relation with maximum magnetic attraction as a user brings the two wings together for affixing the cover body in a closed position.

15. The head cover of claim 13, wherein the magnetized materials are embodied as two pairs of magnets.

16. The head cover of claim 13, wherein the magnetized materials exhibit a pull force of less than five (5) pounds.

17. The head cover of claim 13, wherein size of the magnetized materials is adjustable to vary the pull force of magnetic attraction.

* * * * *